US010947653B2

(12) United States Patent
Koschnick et al.

(10) Patent No.: US 10,947,653 B2
(45) Date of Patent: Mar. 16, 2021

(54) MATERIAL WEB FIXING DEVICE AS PART OF A FILTER BAG MANUFACTURING INSTALLATION

(71) Applicant: PFAFF Industriesysteme und Maschinen GmbH, Kaiserslautern (DE)

(72) Inventors: Frank Koschnick, Lorsch (DE); Berthold Becker, Rimbach (DE)

(73) Assignee: PFAFF Industriesysteme und Maschinen GmbH, Kaiserslautern (DE)

( * ) Notice: Subject to any disclaimer, the term of this patent is extended or adjusted under 35 U.S.C. 154(b) by 319 days.

(21) Appl. No.: 16/081,179

(22) PCT Filed: Feb. 28, 2017

(86) PCT No.: PCT/EP2017/054555

§ 371 (c)(1),
(2) Date: Aug. 30, 2018

(87) PCT Pub. No.: WO2017/148886

PCT Pub. Date: Sep. 8, 2017

(65) Prior Publication Data

US 2019/0071806 A1 Mar. 7, 2019

(30) Foreign Application Priority Data

Mar. 1, 2016 (DE) ..... 10 2016 203 358.1

(51) Int. Cl.
*D05B 13/00* (2006.01)
*D05B 33/02* (2006.01)

(52) U.S. Cl.
CPC ..... *D05B 13/00* (2013.01); *D05B 33/02* (2013.01); *B65H 2301/46327* (2013.01)

(58) Field of Classification Search
CPC ..... D05B 13/00; D05B 33/02; D05B 13/02; B65H 2301/46327; B01D 29/11
See application file for complete search history.

(56) References Cited

U.S. PATENT DOCUMENTS 1,697,706 A 1/1929 Bartlett
1,794,366 A 3/1931 Walter et al.
(Continued)

FOREIGN PATENT DOCUMENTS

DE 4332111 C1 1/1995
DE 202005014523 U1 11/2005
(Continued)

*Primary Examiner* — Tajash D Patel
(74) *Attorney, Agent, or Firm* — Smartpat PLC

(57) ABSTRACT

A material web fixing device is used as part of a filter bag manufacturing installation. A material web transport device is used to transport at least two material webs, which fixed together at a distance from one another by at least one fixing seam, along a transport direction. A plurality of sewing units each have stitch forming tools configured as a sewing needle and a looper which interact with a thread. The material webs can be passed through between said stitch forming tools in the transport direction. An excess thread production unit is used to lengthen a thread path between the material webs. The excess thread production unit is arranged between the material webs in the thread run during operation. As a result, a material web fixing device is obtained, which allows filter bags to be produced with larger bag openings, particularly with larger opening extensions between the material webs.

10 Claims, 5 Drawing Sheets

(56) References Cited

U.S. PATENT DOCUMENTS

| | | | | |
|---|---|---|---|---|
| 2,667,132 | A | 1/1954 | Golden | |
| 3,323,280 | A * | 6/1967 | Rausch | B65B 51/07 53/571 |
| 5,445,091 | A | 8/1995 | Bartholoma | |
| 2010/0242819 | A1 | 9/2010 | Fukao | |
| 2011/0185957 | A1 | 8/2011 | Fukao | |
| 2017/0240305 | A1 * | 8/2017 | Spatafora | B65B 51/00 |
| 2018/0132548 | A1 * | 5/2018 | Ronco | A41D 13/018 |
| 2020/0148425 | A1 * | 5/2020 | Bang | B65D 33/18 |

FOREIGN PATENT DOCUMENTS

| | | | |
|---|---|---|---|
| EP | 2233629 | A2 | 9/2010 |
| GB | 445307 | A | 4/1936 |

* cited by examiner

MATERIAL WEB FIXING DEVICE AS PART OF A FILTER BAG MANUFACTURING INSTALLATION

CROSS-REFERENCE TO RELATED APPLICATIONS

This application claims priority of German patent application No. DE 10 2016 203 358.1 filed on Mar. 1, 2016, pursuant to 35 U.S.C. 119(a)-(d), the content of which is incorporated herein by reference in its entirety as if fully set forth herein.

FIELD OF THE INVENTION

The invention relates to a material web fixing device as part of a filter bag manufacturing installation. The invention further relates to a method of fixing at least two material webs at a distance from one another, and to a filter bag manufacturing installation comprising a material web fixing device of this type.

BACKGROUND OF THE INVENTION

A material web fixing device of the type named at the outset is known from the product brochure "FPS300-High-Speed-Fertigungsinstallation für Filtertaschen" (engl.: "FPS300 High Speed Manufacturing Installation for Filter Bags"), available via the applicant's web pages at the filing date of the application. A multi-needle sewing machine is known from DE 20 2005 014 523 U1.

SUMMARY OF THE INVENTION

An object of the present invention is to further develop a material web fixing device of the type named at the outset in such a way as to allow filter bags to be produced with a larger bag opening, particularly with a larger opening extension between the material webs.

According to the invention, this object is achieved by a material web fixing device as part of a filter bag manufacturing installation, comprising a material web transport device for the transport of at least two material webs to be fixed, by means of a fixing seam, at a distance from one another along a transport direction, a plurality of sewing units with in each case one sewing needle and a looper acting as stitch forming tools between which the material webs can be passed through in the transport direction, the stitch forming tools interacting with a thread to produce the fixing seam, an excess thread production unit to lengthen a thread path between the material webs, the excess thread production unit being arranged in the thread run between the material webs during operation, the excess thread production unit having in each case an oblique surface running at an angle to the transport direction, the oblique surface being arranged between the material webs during operation in such a way that it is passed over by the thread during seam formation due to the transport via the material web transport device, with each sewing unit being associated to a respective one of the oblique surfaces.

It was found according to the invention that an excess thread production unit arranged between the material webs produces the excess thread at the point where it is needed for fixing the distance between the material webs. In other words, the excess thread is produced between the material webs and not outside the material webs. For the excess thread thus produced, it is not necessary to draw said excess thread to a position between the material webs by means of an additional drawing unit. The excess thread production unit may be arranged in direct proximity to the stitch forming tools of a sewing unit. The excess thread production unit may be penetrated by a tip of the sewing needle during operation. One particular excess thread production unit can be associated to a respective one of the sewing units. The excess thread production unit allows excess thread paths to be produced, which provide a distance between adjacent material webs of more than 70 mm, for example of 80 mm, 90 mm, 100 mm and even larger distances. A given filter frame can then be provided with a correspondingly lower number of filter bags having a larger opening width.

The excess thread production unit has an oblique surface running in each case obliquely to the transport direction. During operation, said oblique surface is arranged between the material webs in such a way that during stitch formation, the thread passes over the oblique surface due to the transport via the material web transport device. Each sewing unit is associated to a respective one of the oblique surfaces. Oblique surfaces of this type have proven to be particularly suitable to form excess threads between the material webs in an operationally safe manner. The length of the excess thread produced by means of the excess thread production unit can be defined as a function of the deflection of the thread path produced by the oblique surface in a direction transverse to the transport direction.

Configuring the excess thread production unit as at least one sheet metal part with a plurality of oblique surfaces each, with a respective one of the oblique surfaces being provided for each sewing unit, reduces the manufacturing costs. It is conceivable to use a plurality of sheet metal parts of this type each having a plurality of oblique surfaces. Alternatively, it is conceivable to provide a separate excess thread production unit for each unit.

An oblique surface orientation of at least two oblique surfaces counter to one another such that the resulting forces applied by these oblique surfaces to the material webs in a direction transverse to the transport direction when passed over by the thread act in opposite directions reduces the risk of an unwanted lateral offset between the material webs in the operation of the material web fixing device. A resulting total force applied by the oblique surfaces to the material webs in a direction transverse to the transport direction when passed over by the thread may be 0 or may be approximately 0.

An excess thread production unit, which is adjustable between various default positions to define various thread path lengthening dimensions, allows filter bags to be produced with predefinable opening widths. In order to predefine various thread path lengthening dimensions, the excess thread production unit can be displaceable transversely to the material web transport direction.

An excess thread production unit, which is displaceable during the seam forming process, allows the excess thread produced between the material webs by means of said unit to be lengthened even more. To achieve this additional lengthening, the excess thread production unit can be displaceable transversely to the material web transport direction in the stitch forming process.

An additional excess thread production unit comprising at least one additional excess thread production unit to additionally lengthen the thread path between two stitches of the fixing seam by an additional thread path, the additional excess thread production unit being arranged, during operation, outside the two material webs in the thread run facing the sewing needle, and at least one thread drawing unit to draw the additional thread path, which is first disposed outside the material webs, into the thread run between the material webs provides the possibility of producing a total excess thread, which is longer than the excess thread produced between the material webs by means of the excess thread production unit. The thread drawing unit can be configured as a plurality of thread drawing wires associated to in each case one sewing unit and running obliquely to the transport direction. During operation, these thread drawing wires can be arranged between the material webs in such a way that they are passed over by the thread during stitch formation due to the transport via the material web transport device.

Configuring the additional excess thread production unit as a thread finger, which is drivable to be displaced transversely to the transport direction and is arranged locally between the sewing needle in the top dead center and the material webs, the thread finger being configured such as to initially lengthen the thread path during seam formation, wherein the thread comes out of contact with the thread finger once the thread path has been lengthened due to the transport via the material web transport device, proved to be suitable.

The advantages of a method of fixing at least two material webs at a distance from one another, the method comprising the steps of transporting the material webs along a transport direction to pass through between the stitch forming tools of a plurality of sewing units, producing a fixing seam by means of the stitch forming tools by using a thread with a lengthened thread path, and lengthening the thread path of the fixing seam during seam formation by means of an excess thread production unit arranged between the material webs correspond to those that have already been explained above with reference to the material web fixing device. The method can be carried out using a material web fixing device according to the invention.

The advantages of a filter bag manufacturing installation comprising a material web fixing device according to the invention, a sealing device for sealing the fixing seam formed in such a way that the material webs are permanently fixed at a distance from one another by means of the thread, and a material web edge joining device for closing side seams and/or bottom seam to form a ready-to-use filter bag correspond to those that have already been explained above with reference to the material web transport device according to the invention. A permanent fixing can be carried out with the sealing device by means of hot glue, for example. Connecting the edges can be carried out by sewing and/or ultrasonic welding.

An exemplary embodiment of the invention will hereinafter be explained in more detail by means of the drawing.

DETAILED DESCRIPTION

Figure 5:
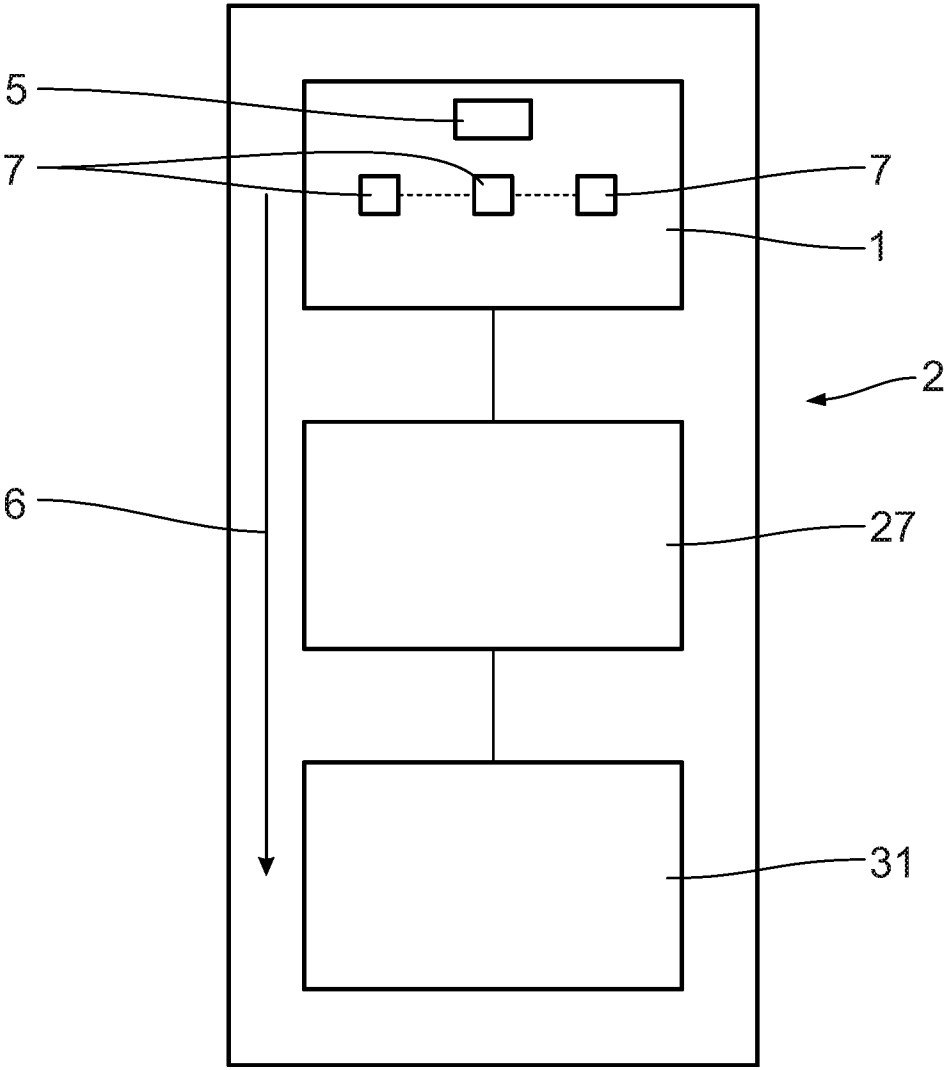
FIG. 5 shows a highly schematic view of component groups of the filter bag manufacturing installation comprising the material web fixing device.

A material web fixing device 1 is part of a filter bag manufacturing installation 2 shown in an extremely schematic view in FIG. 5. The filter bag manufacturing installation 2 is used to manufacture filter bags the bag walls of which are formed by two material webs 3, 4 shown in FIGS. 2 and 3. In accordance with its orientation when being processed in the material web fixing device 1, the material web 3 is referred to as upper material web while the material web 4 is referred to as lower material web. A plurality of filter bags thus produced can be inserted into a common filter frame (not shown) at a later point in time, wherein adjacent ones of the filter bags bear against one another with their long bag opening front edges. The short front edges of the filter bag openings have a dimension greater than 70 mm, in particular amounting to 100 mm. A frame with an edge length of 600 mm×600 mm can be filled completely with a total of six filter bags with filter bag openings dimensioned and arranged in this manner (100 mm×600 mm).

Figure 1:
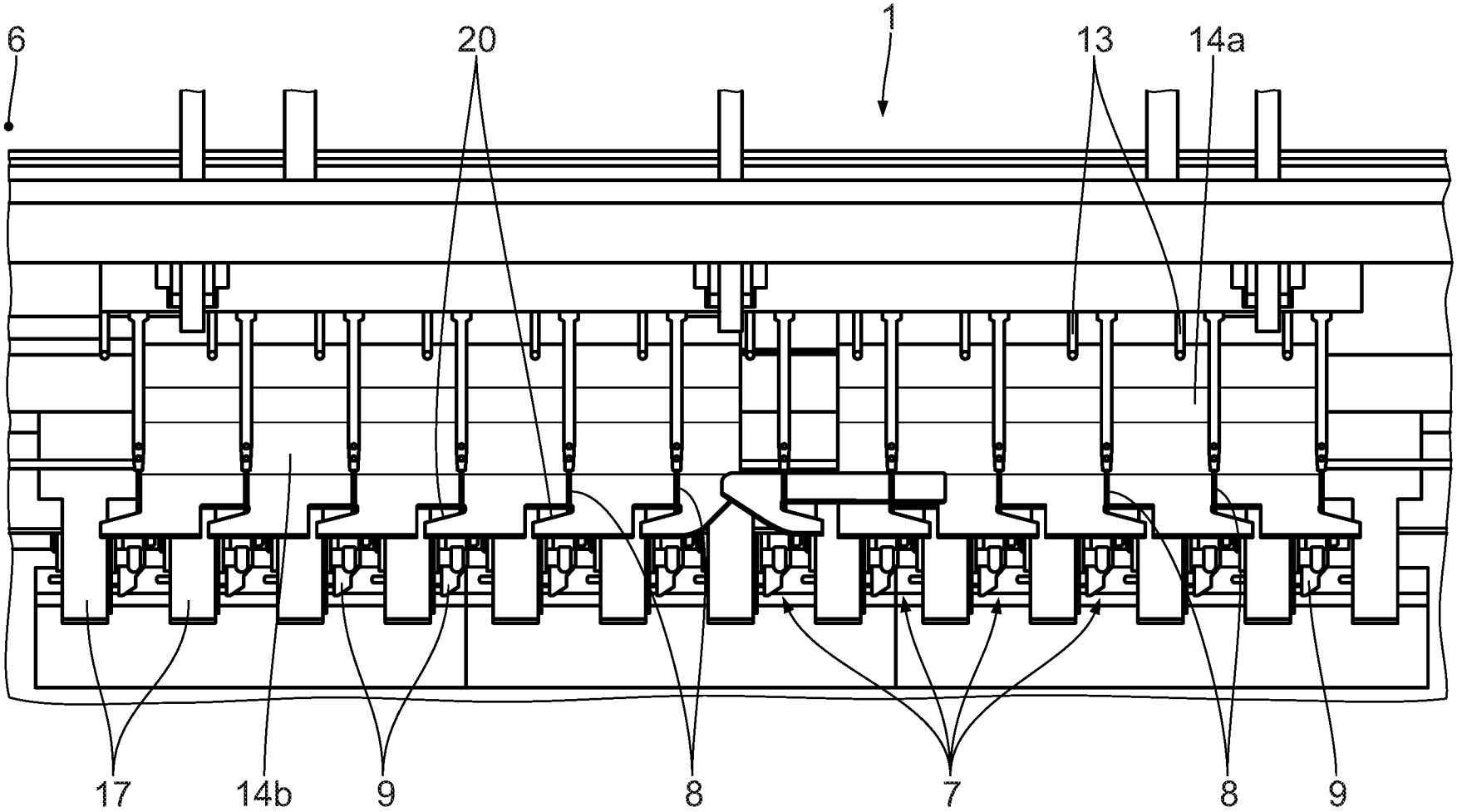
FIG. 1 shows a perspective sectional view of a material web fixing device as part of a filter bag manufacturing installation, seen from a direction counter to a material web transport direction.
Figure 2:
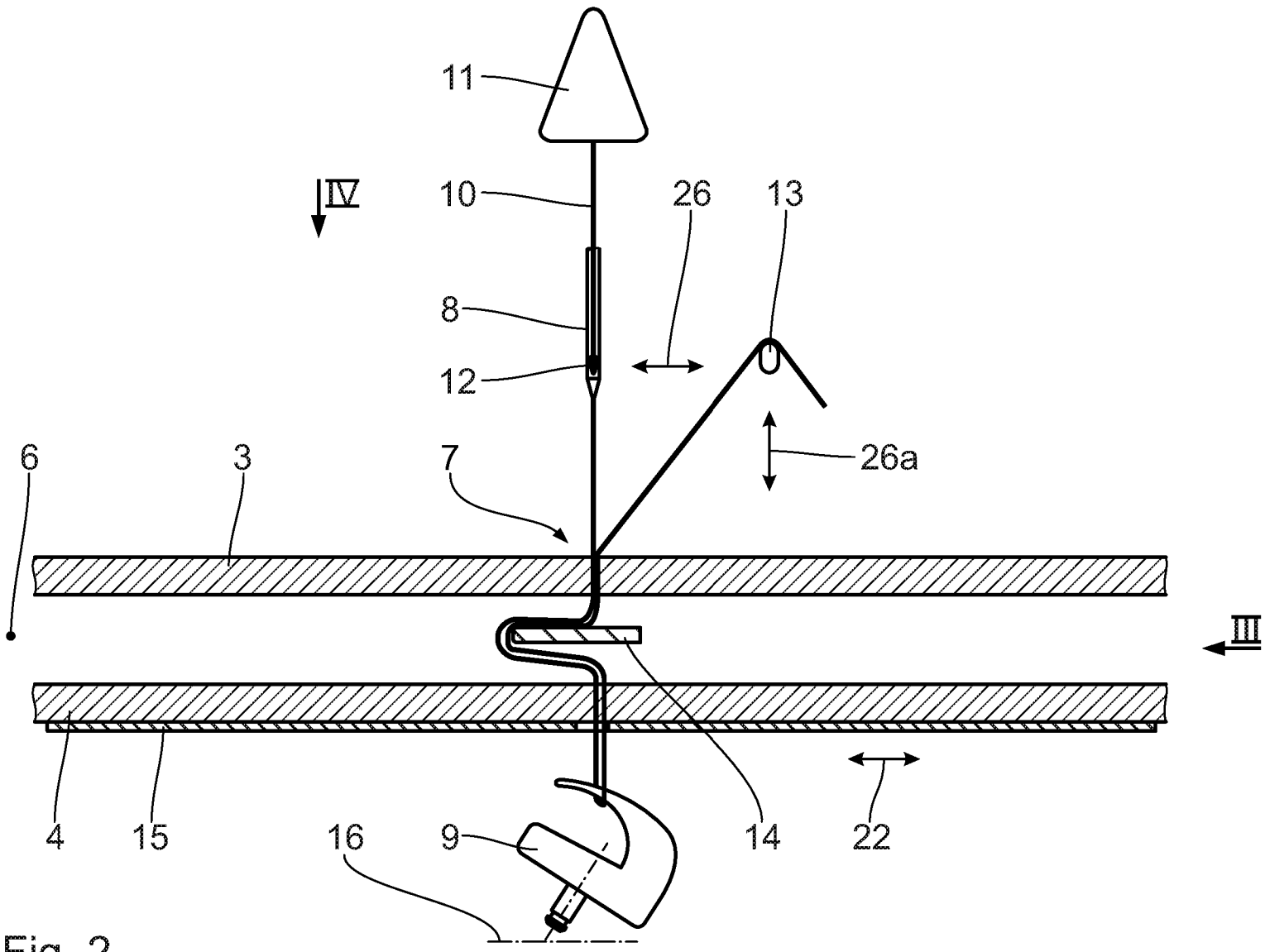
FIG. 2 shows a more schematic view of components of the material web fixing device, seen also from a direction counter to the material web transport direction, the components shown being associated to precisely one sewing unit of a plurality of sewing units of the material web fixing device, with a stitch plate and two material webs fixed at a distance from one another being shown in a partly sectional view in addition to thread guide components.

The material web fixing device 1 has a material web transport device 5 shown only schematically in FIG. 5 to transport the two material webs 3, 4 along a transport direction 6. In FIGS. 1 and 2, the transport direction 6 runs perpendicular to the drawing plane and out of the latter.

The material web fixing device 1 has a plurality of sewing units 7. Said sewing units 7 each have a sewing needle 8 and a thread looper 9 serving as stitch forming tools interacting with a sewing thread 10. FIG. 1 shows an exemplary view of eleven sewing units 7 arranged adjacent to each other and perpendicular to the transport direction 6. The material web fixing device 1 is actually provided with a total of twelve sewing units 7 arranged adjacent to each other and perpendicular to the transport direction 6.

Figure 3:
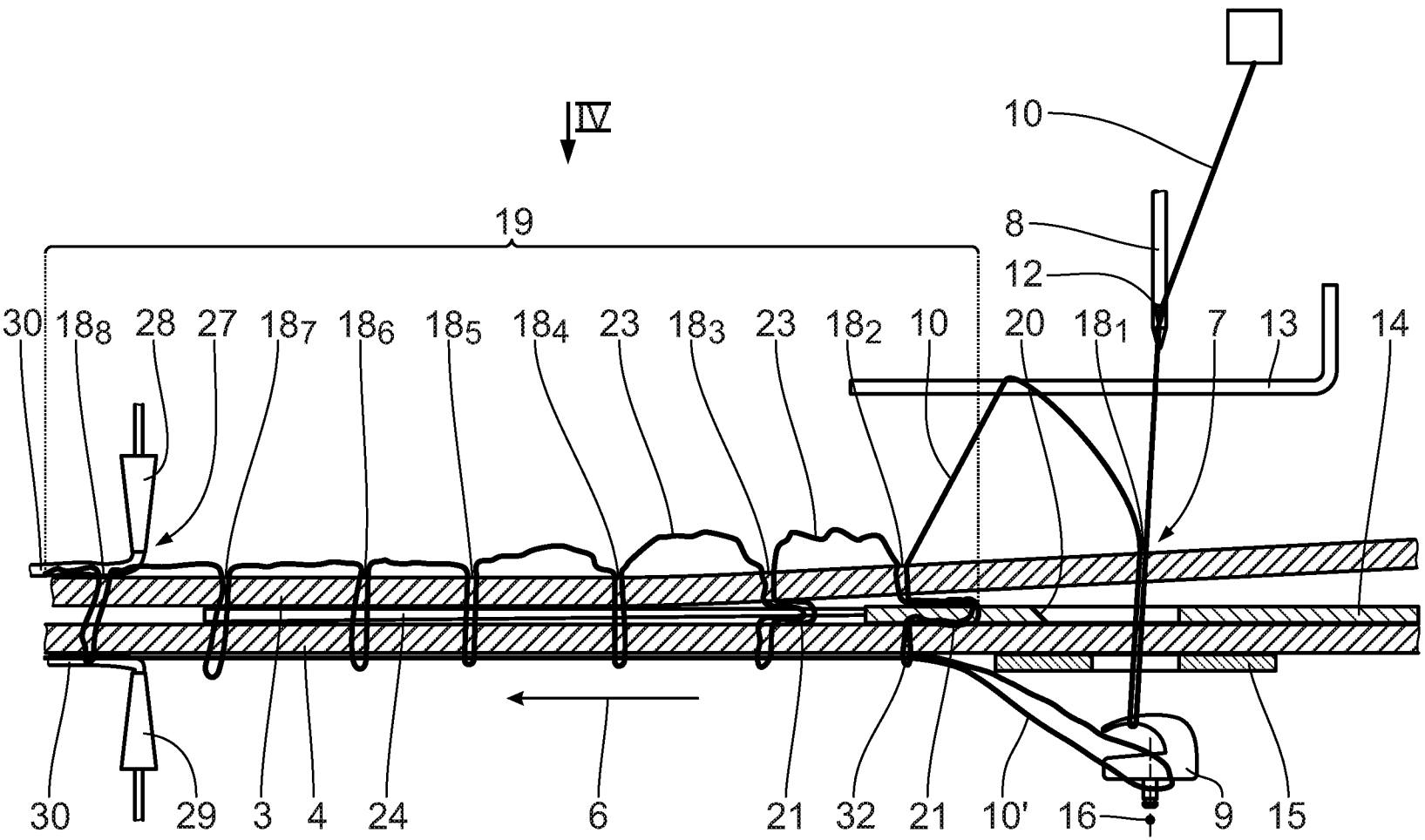
FIG. 3 shows another sectional view of components of the material web fixing device, seen from viewing direction III in FIG. 2.

The thread path of a sewing unit 7 is shown in FIG. 3, for example: here, the thread runs from a conical thread reel 11 via an eye 12 of the needle 8 and past an additional excess thread production unit 13 configured as a thread finger. The thread 10 then passes through the upper material web 3 and runs past an excess thread production unit 14 arranged between the material webs 3, 4, the excess thread production unit 14 being configured as a thread drawing sheet metal plate. Subsequently the thread 10 passes through the lower material web 4 and a stitch plate 15 of the material web fixing device 1. During stitch formation, the thread 10 then winds around the looper tip of the associated looper 9 of the sewing unit 7.

The looper 9 is drivable to rotate about a looper shaft 16 running transversely to the transport direction 6. For illustrative reasons, the looper is shown in a view rotated through 90° in FIG. 2. The looper shafts 16 are each mounted in respective shaft supports 17 of the material web fixing device 1.

The excess thread production unit 14 serves to lengthen a thread path when forming a fixing seam 19 between the two material webs 3, 4. In FIG. 1, the stitches 18 are marked by an index 1, 2 counter to their order of production.

For each of the sewing units 7, the excess thread production unit 14 has a respective oblique surface 20 extending at an angle to the transport direction 6. In the operation of the fixing device 1, said oblique surface 20 is arranged between the material webs 3, 4 in such a way that it is passed over by the thread 10 during stitch formation due to the transport via the material web transport device 5, causing said oblique surface 20 to be deflected transversely to the transport direction 6. As a result, excess thread 21 is produced directly between the material webs 3 and 4. In other words, the thread 10 needs to travel along a path during stitch formation, which—because of the thread drawing sheet metal plate 14 and the oblique surface 20 thereof—is longer than it would be if no thread drawing sheet metal plate 14 was provided. As can be seen directly from FIG. 1, one of the oblique surface 20 is in each case associated to a respective one of the sewing units 7.

In the embodiment according to FIG. 1, the excess thread production unit 14 is formed by a total of two sheet metal plates 14*a* and 14*b*. Each of these thread drawing sheet metal plates 14*a*, 14*b* has six oblique surfaces 20 each, which are each associated to a respective one of the sewing units 7. With respect to their extension in the oblique direction, the six oblique surfaces 20 of the sheet metal plate 14*a* are oriented counter to the six oblique surfaces 20 of the sheet metal plate 14*b*. Resulting forces applied to the material webs 3, 4 by these oblique surfaces 20 of the sheet metal plates 14*a*, 14*b* in a direction transverse to the transport direction 6 when passed over by the thread then act in directions opposite to each other. A total force applied to the material webs 3, 4 by these oblique surfaces 20 of the sheet metal plates 14*a*, 14*b* transversely to the transport direction 6 when passed over by the thread may then be 0 or virtually 0.

The excess thread production unit 14 may be adjustable to define various thread path lengthening dimensions, in other words various lengths of the excess thread 21 produced transversely to the transport direction 6 between various default positions (see double arrow 22 in FIG. 2). In FIG. 1, the two thread drawing sheet metal plates 14*a*, 14*b* are each shown in the default position "maximum excess thread". As an alternative or in addition thereto, the excess thread production unit 14 may be displaceable, in particular drivable to be displaced, transversely to the transport direction 6 during stitch formation to produce said excess thread.

Figure 4:
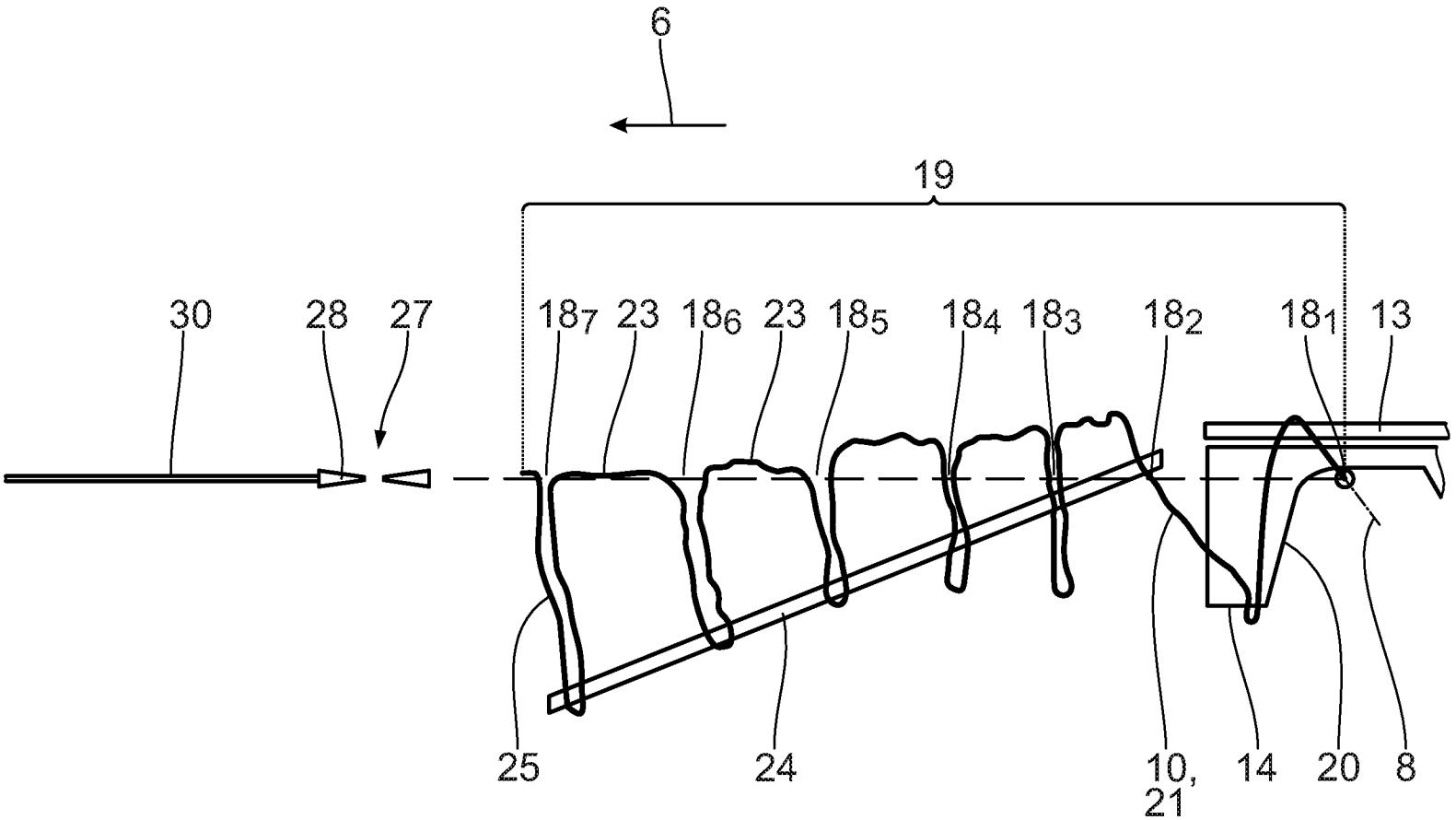
FIG. 4 shows another sectional view of components of the material web fixing device, seen from viewing direction IV in FIGS. 2 and 3.

The additional excess thread production unit 13 serves to additionally lengthen the thread path between two stitches $\mathbf{18}_i$, $\mathbf{18}_{i+1}$ by an additional thread path 23 (see FIGS. 3 and 4). In the operation of the fixing device 1, the additional excess thread production unit 13, in other words the thread finger associated to a respective one of the sewing unit 7, is arranged outside the two material webs 3, 4 in the thread path facing the sewing needle 8. In the orientation of the fixing device 1 shown in the drawing, both the sewing needle 8 and the thread finger 13 are arranged above the upper material web 3.

The fixing device 1 further has a thread drawing unit 24 associated to the respective sewing unit 7 to draw the additional thread path 23, which is first provided outside the two material webs 3, 4, into the thread run between the material webs 3, 4. The thread drawing unit 24 is configured as a plurality of thread drawing wires extending obliquely to the thread direction 6, the thread drawing wires being associated to a respective one of the sewing units 7. In the operation of the fixing device 1, these are arranged between the material webs 3 and 4 (see FIG. 3). This arrangement is such that the respective thread drawing wire 24 is passed by the thread 10 during stitch formation due to the transport via the material web transport device 5. Once the thread has passed by the respective thread drawing wire 24, the excess thread 21 produced by the excess thread production unit 14 and the additional thread path 23 produced by the additional excess thread production unit 13 add up to form a total excess thread 25 between the material webs 3 and 4.

The additional excess production unit 13 is configured as a thread finger drivable to be displaced transversely to the transport direction 6 (see double arrow 26 in FIG. 2). This thread finger displacement may be an oscillating movement synchronized with the stitch formation. As an alternative or in addition thereto, it is conceivable for the thread fingers 13 associated to the sewing units 7 to be displaced in a direction perpendicular to a web plane of the material webs 3, 4 (see double arrow 26*a*) in the seam forming process. This allows the additional thread path 23 produced during seam formation to be varied along the fixing seam 19.

The thread fingers 13 are each arranged locally between the needle 8 in the top dead center and the material webs 3, 4. The thread finger 13 is configured such as to lengthen the thread path during stitch formation; once the thread path has been lengthened by means of the thread finger 13, the thread 10 comes out of contact with the thread finger 13, which is not transported together with the material web 3, 4, due to the transport via the material web transport device 5.

In addition to the material web fixing device 1, the filter bag manufacturing installation 2 further includes a sealing device 27 for sealing the stitches formed such that the material webs 3 and 4 are permanently fixed at a distance from one another by means of the thread 10. The sealing device 27 is configured as a pair of hot glue nozzles 28, 29 associated to a respective one of the sewing units 7 via which glue 30 (see FIG. 3) is applied to the fixing seam 19 from above and to the material webs 3, 4 from below after the total excess thread 25 has been produced.

The filter bag manufacturing installation 2 further includes a material web edge joining device 31 to close side seams and bottom seam of the filter bag comprising the two material webs 3, 4. Joining the edges can be performed by sewing and/or ultrasound welding.

When fixing the two material webs 3, 4 at a distance from one another by means of the material web fixing device 1 and the other components of the filter bag manufacturing installation, the material webs 3 and 4 are passed through between the stitch forming tools 8 and 9 of the sewing units 7 along the transport direction 6. The stitches $\mathbf{18}_i$ are produced by means of the sewing needle 8, with the thread 10 being transported through the two material webs 3, 4 to the looper 9. A thread loop is then picked up by the looper and wound around another thread portion 10' running below the lower material web 4. This causes knots 32 (see FIG. 3) to form between the thread 10 transported through the material webs 3 and 4 and the thread portion 10'.

When producing the fixing seam 19, the thread path is lengthened on the one hand between the material webs 3 and 4 by means of the excess thread production unit 14 and between two stitches $\mathbf{18}_i$, $\mathbf{18}_{i+1}$ by means of the additional excess thread production unit 13 on the other. The additional thread path 23 produced by the additional excess thread production unit 13 is drawn, by means of the thread drawing unit 24, between the material webs 3 and 4 as well, with the result that for each stitch 18, there is a total excess thread path 25 between the respective knot 32 and the associated needle entry into the upper material web 3, said total excess thread path 25 providing a distance of 100 mm between the two material webs 3, 4 when the thread 10 is tensioned.

The total excess thread path 25 can be varied by correspondingly setting the excess thread production unit 14 and/or the additional excess thread production unit 13 along the fixing seam 19, with the result that a filter bag is obtained that has a conical shape in the direction of a bag bottom. Having produced the total excess thread path 25, the thread 10 and the thread portion 10' are sealed together below the upper material web 3 and below the lower material web 4 by means of the two hot glue nozzles 28, 29 of the sealing device 27 to permanently secure the thread 10, 10' to the material webs 3 and 4. Subsequently, side seams and bottom seams of the filter bag are closed by means of the material web edge joining device 31. The filter bag is now ready for use and can be inserted into the pre-fabricated filter frame together with other filter bags.

The invention claimed is:

1. A material web fixing device as part of a filter bag manufacturing installation, comprising a material web transport device for the transport of at least two material webs to be fixed, by means of a fixing seam, at a distance from one another along a transport direction, a plurality of sewing units with in each case one sewing needle and a looper acting as stitch forming tools between which the material webs can be passed through in the transport direction, the stitch forming tools interacting with a thread to produce the fixing seam, an excess thread production unit to lengthen a thread path between the material webs, the excess thread production unit being arranged in the thread run between the material webs during operation, the excess thread production unit having in each case an oblique angled surface that lengthens the thread path relative to the transport direction, the oblique angled surface being arranged between the material webs during operation in such a way that it is passed over by the thread during seam formation due to the transport via the material web transport device, with each sewing unit being associated to a respective one of the oblique angled surfaces.

2. The material web fixing device according to claim 1, wherein the excess thread production unit is configured as at least one sheet metal plate with a plurality of oblique surfaces, which a respective one of the oblique surfaces being provided for each sewing unit.

3. The material web fixing device according to claim 2, wherein the excess thread production unit has a plurality of sheet metal plates with a plurality of oblique surfaces each, with a respective one of the oblique surfaces being provided for each sewing unit.

4. The material web fixing device according to claim 1, wherein at least two oblique surfaces are oriented counter to one another such that the resulting forces applied by these oblique surfaces to the material webs in a direction transverse to the transport direction when passed over by the thread act in opposite directions.

5. The material web fixing device according to claim 1, wherein the excess thread production unit is adjustable between various default positions to define various thread path lengthening dimensions.

6. The material web fixing device according to claim 1, wherein the excess thread production unit is displaceable during the seam forming process.

7. The material web fixing device according to claim 1, comprising at least one additional excess thread production unit to additionally lengthen the thread path between two stitches of the fixing seam by an additional thread path, the additional excess thread production unit being arranged, during operation, outside the two material webs in the thread run facing the sewing needle, at least one thread drawing unit to draw the additional thread path, which is first disposed outside the material webs, into the thread run between the material webs.

8. The material web fixing device according to claim 7, wherein the additional excess thread production unit, which is configured as a thread finger that is drivable to be displaced transversely to the transport direction, is arranged locally between the sewing needle in the top dead center and the material webs, wherein the thread finger is configured such as to initially lengthen the thread path during seam formation, wherein the thread comes out of contact with the thread finger once the thread path has been lengthened due to the transport via the material web transport device.

9. A method of fixing at least two material webs at a distance from one another, the method comprising the following steps:

transporting the material webs along a transport direction to pass through between the stitch forming tools of a plurality of sewing units, producing a fixing seam by means of the stitch forming tools by using a thread with a lengthened thread path, lengthening the thread path of the fixing seam during seam formation by means of an excess thread production unit arranged between the material webs.

10. A filter bag manufacturing installation comprising a material web fixing device according to claim 1, a sealing device for sealing the fixing seam formed in such a way that the material webs are permanently fixed at a distance from one another by means of the thread, a material web edge joining device for closing side seams and/or bottom seam to form a ready-to-use filter bag.

* * * * *